United States Patent [19]

Sampson et al.

[11] Patent Number: 4,928,445

[45] Date of Patent: May 29, 1990

[54] SKYLIGHT CONSTRUCTION

[75] Inventors: Robert Sampson, Sanford; Sean Flanigan, Wells, both of Me.

[73] Assignee: Wasco Products, Inc., Sanford, Me.

[21] Appl. No.: 283,803

[22] Filed: Dec. 13, 1988

[51] Int. Cl.[5] ..... E04B 7/18

[52] U.S. Cl. ..... 52/72; 52/200; 52/403; 49/485; 49/495

[58] Field of Search ..... 52/200, 72, 403, 397; 49/485, 495, DIG. 1

[56] References Cited

U.S. PATENT DOCUMENTS

| | | | |
|---|---|---|---|
| 2,661,229 | 12/1953 | Slaughter, Jr. | 49/495 |
| 2,853,330 | 9/1958 | Harry | 52/403 |
| 3,327,429 | 6/1967 | Slaughter | 49/485 |
| 3,996,844 | 12/1976 | Leurent | 52/200 |
| 4,388,784 | 6/1983 | Jentoft et al. | 52/200 |
| 4,449,340 | 5/1984 | Jentoft et al. | 52/200 |
| 4,455,799 | 6/1984 | Jentoft et al. | 52/200 |
| 4,702,049 | 10/1987 | Sampson | 52/200 |

*Primary Examiner*—Carl D. Friedman
*Assistant Examiner*—Caroline D. Dennison
*Attorney, Agent, or Firm*—Wolf, Greenfield & Sacks

[57] ABSTRACT

A skylight adapted to fit within the opening of a roof or the like having a peripheral curb frame which is fixed to the roof about the opening. The frame is constructed of a plastic material and includes a retainer for securing the skylight cover over the curb frame. A sealing gasket is provided integral with the frame and, in one embodiment, seals between frame sections, and in another embodiment, seals with the skylight glazing.

29 Claims, 5 Drawing Sheets

34
22
56
17
18
16
2
22
34
56
17
20
60
14
25
36
28
14
52
50
51
44
25
40
118
11A
11
10
28
2

SKYLIGHT CONSTRUCTION

BACKGROUND OF THE INVENTION

1. Field of the Invention

The present invention relates in general to an improved skylight construction and is concerned, more particularly, with an improved skylight construction preferably formed of a coextruded plastic material, thus adapting itself to simplified manufacture and having improved temperature resistant and weathering properties. Even more particularly, the present invention relates to an improved gasket construction for the skylight, and one that is in particular characterized by improved weather and air tightness.

2. Background Discussion

An existing skylight construction is shown, by way of example, in U.S. Pat. No. 4,449,340, granted May 22, 1984 and owned by the present assignee herein. This existing skylight construction is of plastic, including a frame that is comprised of a base frame and an operating leaf frame. A retainer that may be constructed of a lightweight metal material is typically employed for holding the glazing to the curb frame. Gasketing is typically provided between the glazing and the frame as well as between the frame components.

In connection with the gasketing that is typically provided in skylight constructions, and with reference to assignee's U.S. Pat. No. 4,449,340, it is noted that a tubular type gasket is employed between curb frame sections for providing an essentially single area sealing contact. In single piece curb frame sections, such as exemplified in the U.S. Pat. No. 4,455,799, it is typical to provide a cup-shaped gasket for sealing with the dome or glazing. However, such arrangements require the coextrusion of different configuration gaskets depending upon whether it is single piece or two piece curb frame application. Also, the gasketing generally provides only single area sealing contact.

Accordingly, it is an object of the present invention to provide an improved skylight construction, and in particular a skylight construction having an improved gasket system that is universally adaptable and useable in either single piece or multiple piece curb frame sections.

A further object of the present invention is to provide an improved sealing gasket for a skylight which is configured so as to provide proper sealing for both the application in which it is adapted to seal between curb frame sections as well as the application in which it is adapted to seal between the curb frame and covering or glazing.

Still another object of the present invention is to provide an improved skylight construction having an improved sealing gasket arrangement, and one which in particular provides multiple area sealing contact.

SUMMARY OF THE INVENTION

To accomplish the foregoing and other objects of this invention, there is provided a skylight construction adapted to be fitted into an opening in a building such as either a commercial building or a residential building. The skylight construction comprises a frame means that is of plastic construction, such as constructed of extruded PVC. The frame means or curb frame, extends about the opening and includes means for the securing thereof about the opening. The skylight construction also includes a translucent or transparent means covering the opening and extending at its edges to overlie the curb frame. The covering means may comprise one or more glazing panels, or may also be in the form of one or more plastic domes. A retainer extends about the periphery of the skylight for holding the glazing on the curb frame.

In the particular embodiment described herein, the curb frame is comprised of a base frame and an operating leaf frame overlying the base frame. However, the principles of the present invention may be employed in connection with either a single part or two part curb frame. The curb frame is constructed of a rigid plastic profile having high temperature resistant properties and preferably having integral therewith and coextruded therewith a flexible sealing flange.

In accordance with the present invention, an improved sealing gasket is provided, and in particular a sealing gasket that is integral with and coextruded with the curb frame. The improved gasket construction provides for multiple area sealing contact. In one embodiment in accordance with the invention the gasket has a centrally disposed contact area as well as a pair of side disposed contact areas and is of generally tubular cross section. In one embodiment of the invention the gasket is adapted for providing a sealing between a base curb frame section and a overlying operative curb frame section. In accordance with another embodiment of the invention, the same gasket construction is useable for providing a sealing between the curb frame and the glazing.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
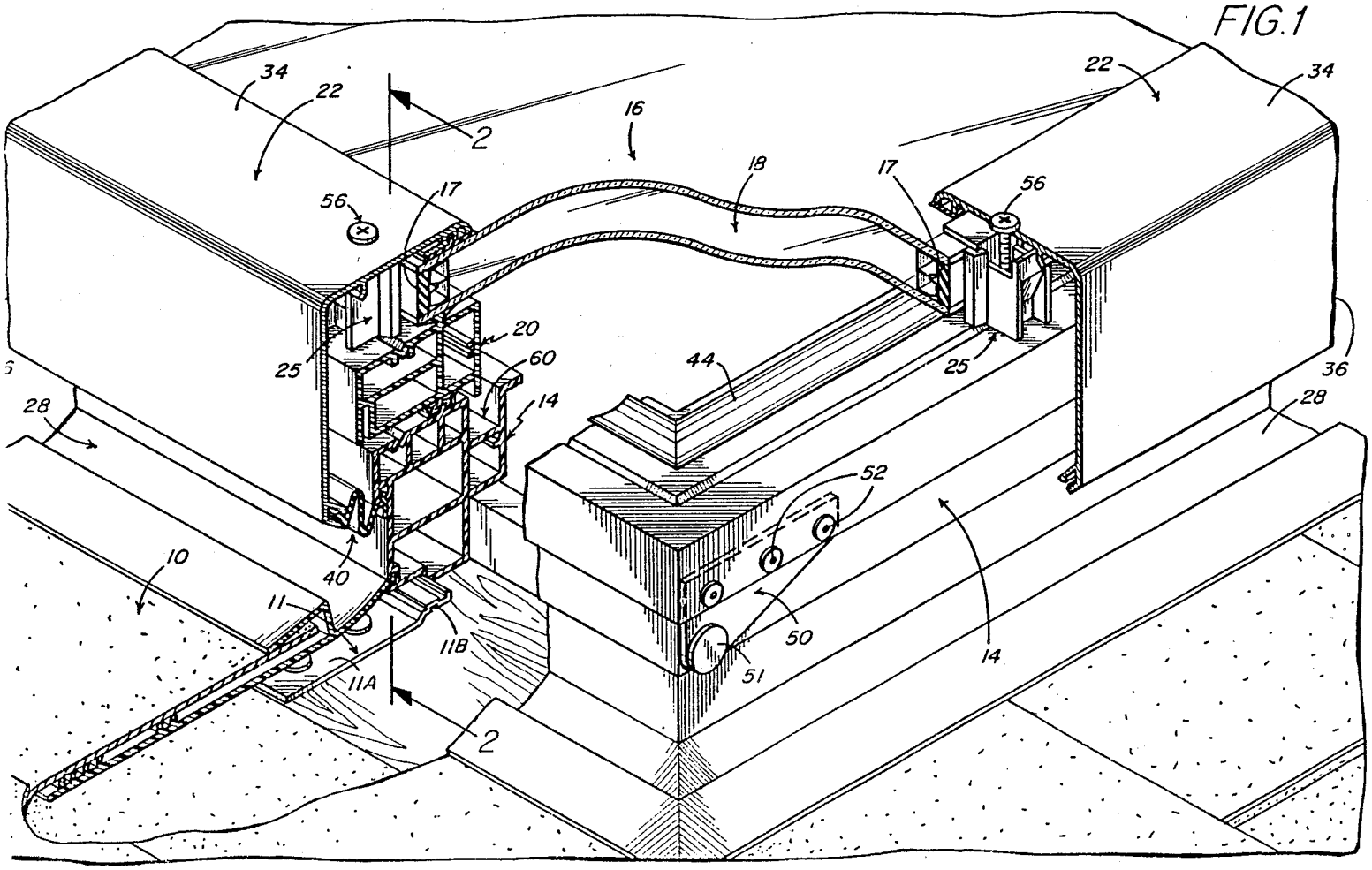
FIG. 1 is a perspective view, partially cut away, and illustrating a skylight construction in accordance with the present invention.
Figure 2:
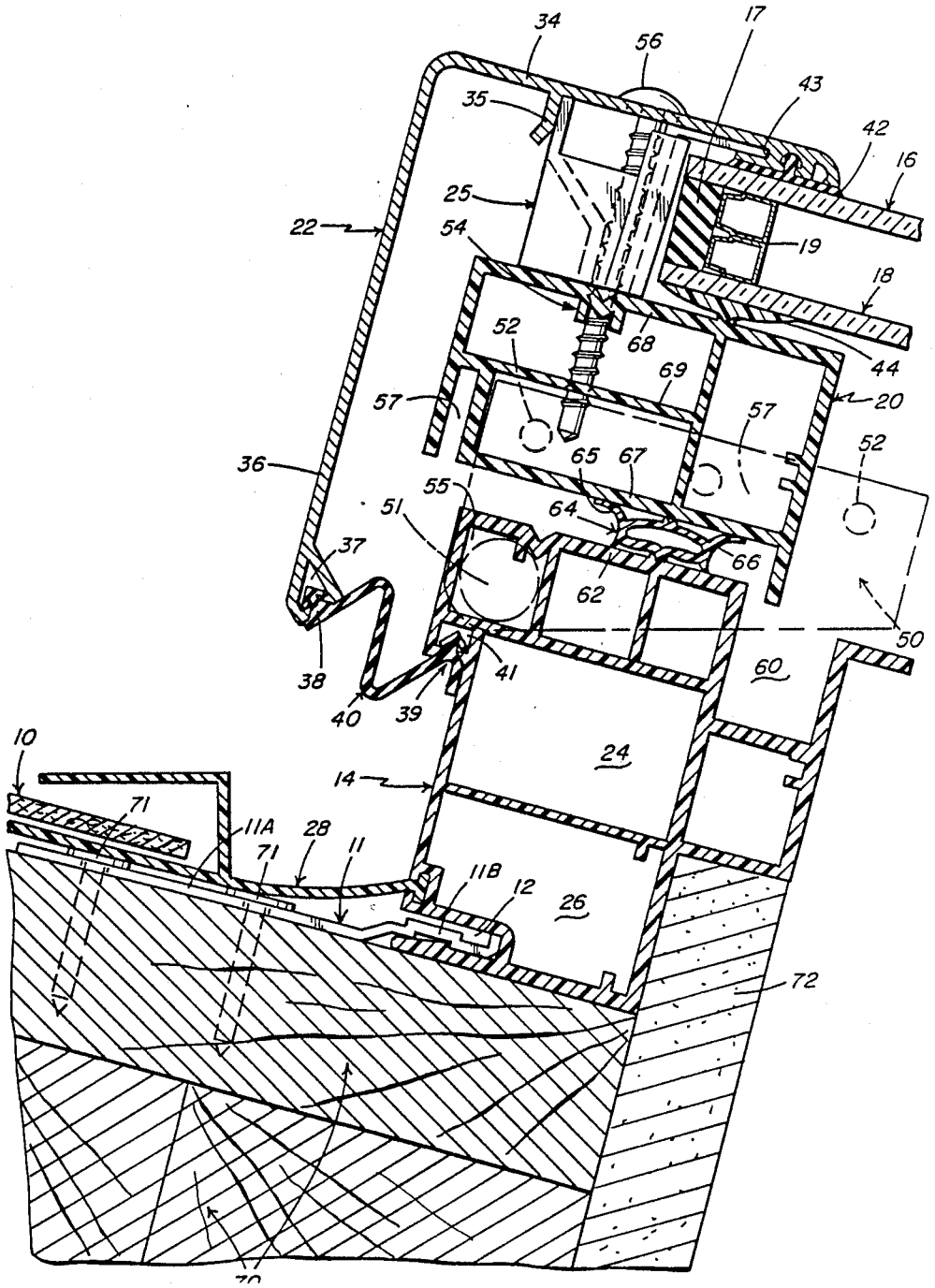
FIG. 2 is a cross-sectional view taken along line 2—2 of FIG. 1 and showing further cross-sectional details of the skylight construction.

Reference is now made to a skylight construction as illustrated in the cut away perspective view of FIG. 1 and the cross-sectional view of FIG. 2. In the embodiment illustrated herein in FIGS. 1 and 2, the skylight is of a flat construction, having flat glazing panels. However, in alternate constructions, a domed type of skylight may also be employed. The skylight is adapted to span an opening which is generally of square or rectangular shape and the opening may be defined by upright walls or by headers within the roof construction.

The skylight described herein is characterized by improved energy performance; thermal air and weather tightness; simplicity of installation; good weathering properties; and enhanced durability.

The skylight construction shown herein includes a pair of glazing panels 16 and 18, a base frame 14, an operating leaf frame 20, and a retainer 22. The two frames 14 and 20 are constructed of a rigid PVC material and these frames are individually coextruded. The retainer 22 is preferably constructed of a lightweight metal material such as aluminum.

Each of the frames 14 and 20 is constructed by a coextrusion process in which a flexible gasket such as gasket 44 is coextruded with a rigid frame section. At the corner mitres, both the rigid and the flexible part of the frames are joined by a technique such as a heat platen sealing technique. This technique commonly joins the rigid frame sections at the corner mitres while at the same time joining the gaskets for providing a continuous seal about the entire skylight curb frame construction.

The base frame 14 may also be referred to as a fixed leaf, while the support frame 20 may also be referred to as the overlying operating leaf. The base frame 14 has internal compartments 24 and 26 and has associated therewith a peripheral sealing flange 28. As indicated, for example, in FIG. 2, the flange 28 interlocks with the base frame 14 and receives a piece of roofing such as the roofing shingle 10 illustrated in FIG. 2. Also refer to FIG. 1 for a clear showing of the manner in which the shingles 10 cooperatively interengage with the sealing flange 28. For further details on the construction and associated function of the sealing flange 28, refer to the assignee's U.S. Pat. No. 4,702,049, granted Oct. 27, 1987.

To secure the skylight, and in particular the base frame 14 thereof, in place on the roof, there are provided a plurality of securing clips 11, each having one end 11*a* for securing the clip to the roof construction and another end 11*b* received by the base frame 14 at the recess 12, as illustrated in FIG. 2. A series of these securing clips 11 may be disposed about all sides of the base frame 14. As illustrated in FIG. 2, the securing clip 11 at its end 11*a* is substantially flat and preferably has two holes for receiving roofing nails. The opposite end 11*b* of the securing clip 11 has a stepped construction to enable the securing clip to interlock in the recess 12 in the base frame 14. The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 2, the frame 19 may be comprised of separate metal spacers with an outer seal comprising a chemically curable two-part polysulfide.

The lower glazing plate 18 rests upon a cup-shaped sealing gasket 44 which is coextruded with the support frame 20. In FIG. 2, the gasket 44 is shown in its compressed position. The operating leaf or support frame 20 also includes means defining a channel 54 for receiving a securing bolt 56. The channel 54 is preferably threaded to receive the bolt 56. There are actually a plurality of these securing bolts or screws that are employed for securing the retainer 22 over the glazing plates 16 and 18. Two of the securing bolts 56 are shown in the perspective view of FIG. 1, each having associated therewith a cushion member 25. The securing bolt 56 actually passes through the glazing securing member 25, forming a cushioning for the edges of the glazing plates to prevent damage thereto, as well as to facilitate positioning thereof.

The retainer 22 has a top leg 34 and a side leg 36. The retainer 22 is generally of L shaped construction. At the bottom end of leg 36 there is provided a pair of walls defining an interlocking channel 37 for receiving one end 38 of the header gasket 40. The other end 39 of the header gasket 40 is received within an interlocking channel 41 formed in the base frame 14. In FIG. 2 the header gasket 40 is shown in the closed position of the skylight with the header gasket thus in its more elongated form.

The top leg 34 of the retainer 22 is also adapted to receive a gasket, illustrated in FIG. 2 as the relatively flat gasket 42 that is interlocked with the very free end of the leg 34. The gasket 42 may be constructed of a premolded butyl material and is adapted to engage with and securely hold the top of the glazing plates, contacting the plate 16 as illustrated in FIG. 2. The top leg 34 also has a depending wall 35 for engagement by the glazing cushion member 25. The leg 34 also includes a slot 43 for receiving a leg of the glass cushion member 25.

As indicated previously, the particular skylight construction depicted herein is in the form of a two-part curb frame with a base frame added overlying the operating frame. For the purpose of opening the operating frame, there are provided hinges 50, one on either side of the skylight. The cut-away perspective view of FIG. 1 shows the hinge 50 having associated therewith a pivot pin 51 and rivets 52. FIG. 2 also shows, in dotted outline, the hinge 50 and the placement of the pop rivets at 52. FIG. 2 also shows, in dotted outline, the pivot pin 51. The pin 51 is adapted to be retained in the channel 55 of the base frame 14. The overlying leaf frame 20 has a peripherally disposed channel 57 and along the sides thereof, the hinge 50 is pop riveted to the frame 20 while the hinge 50 is maintained in this channel 57.

Regarding the base frame 14, as indicated previously, it includes compartments 24 and 26, recess 12 for receiving the securing clip 11, and channels for receiving the pivot pin 51 and the header gasket 40. The base frame 14 also is provided with a condensation gutter 60 and furthermore supports at its top wall 62 the gasket 64. The gasket 64 is constructed to provide multiple sealing points. The gasket 64 is generally of cylindrical construction but is provided with separately disposed ears such as the ears 65 and 66 illustrated in FIG. 2. FIG. 2 clearly illustrates the multiple sealing points of the gasket 64. It is also noted that multiple sealing points are provided not only at the wall 62 but also at the wall 67 of the overlying leaf frame 20. In FIG. 2 the gasket 64 is shown in partially compressed position and providing an effective watertight seal between the separate curb frame sections.

Reference has been made hereinbefore to the bolt 56 as it relates to securing the retainer to the curb frame. As noted in FIG. 2, the bolt 56 preferably passes not only through the threaded channel 54 in wall 68 of the frame 20, but also through the wall 69. In other words, the securing bolt 56 actually penetrates two walls of the frame 20. This adds further stability to the overall skylight construction, particularly as it relates to the retaining of the glazings.

FIG. 2 shows a part of the building construction, including building members 70, which may be of wood construction such as typical 2×4s or 2×6s. FIG. 2 shows the roofing nails 71 used through the securing clip 11 and driven into the members 70. There is also illustrated in FIG. 2 a gypsum board 72 associated with the base frame 14. This is a typical building construction that can be used and that is associated with the skylight.

Figure 3:
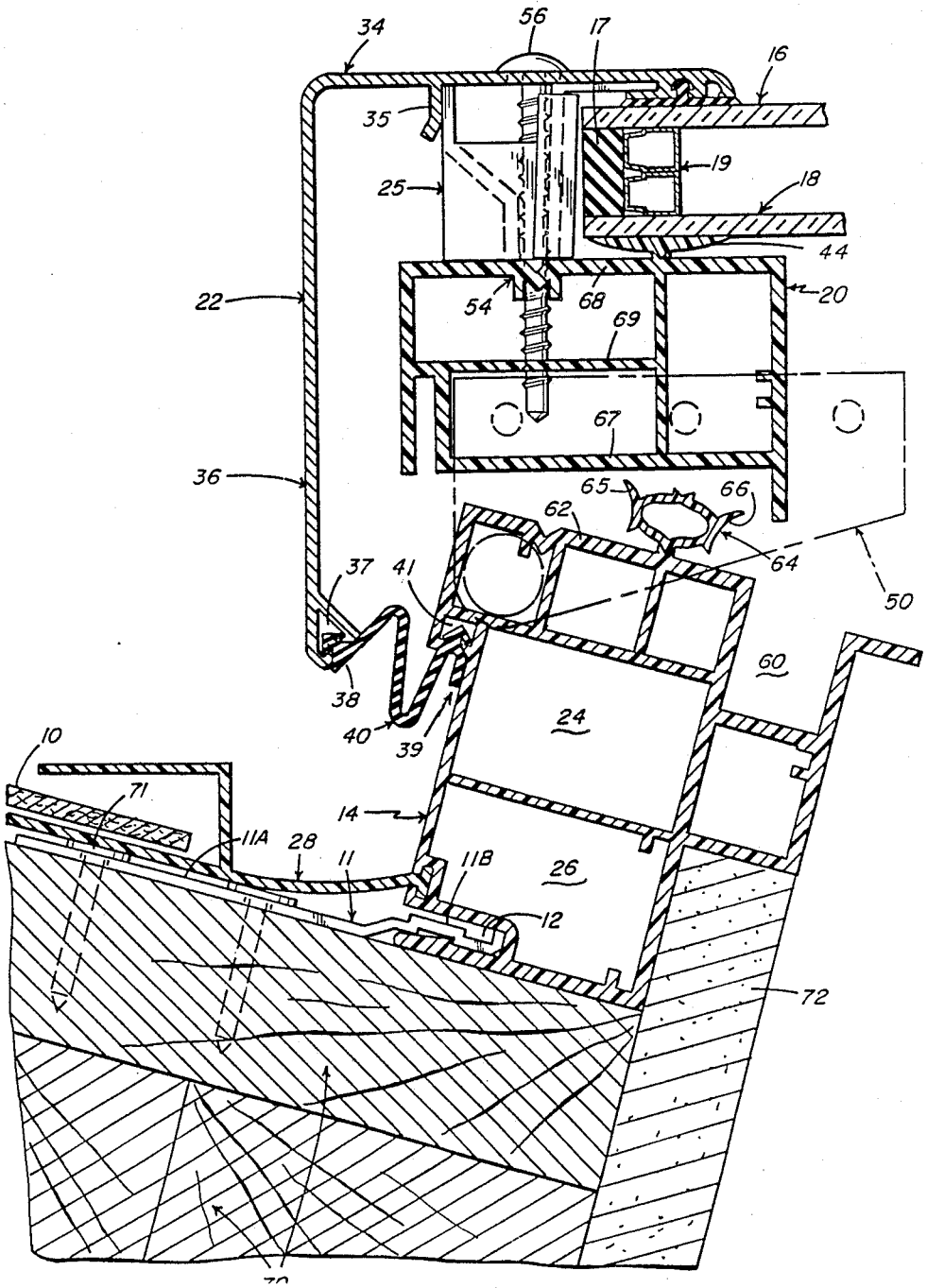
FIG. 3 is a cross-sectional view similar to the cross-sectional view of FIG. 2 but illustrating the skylight in opened position.
Figure 4:
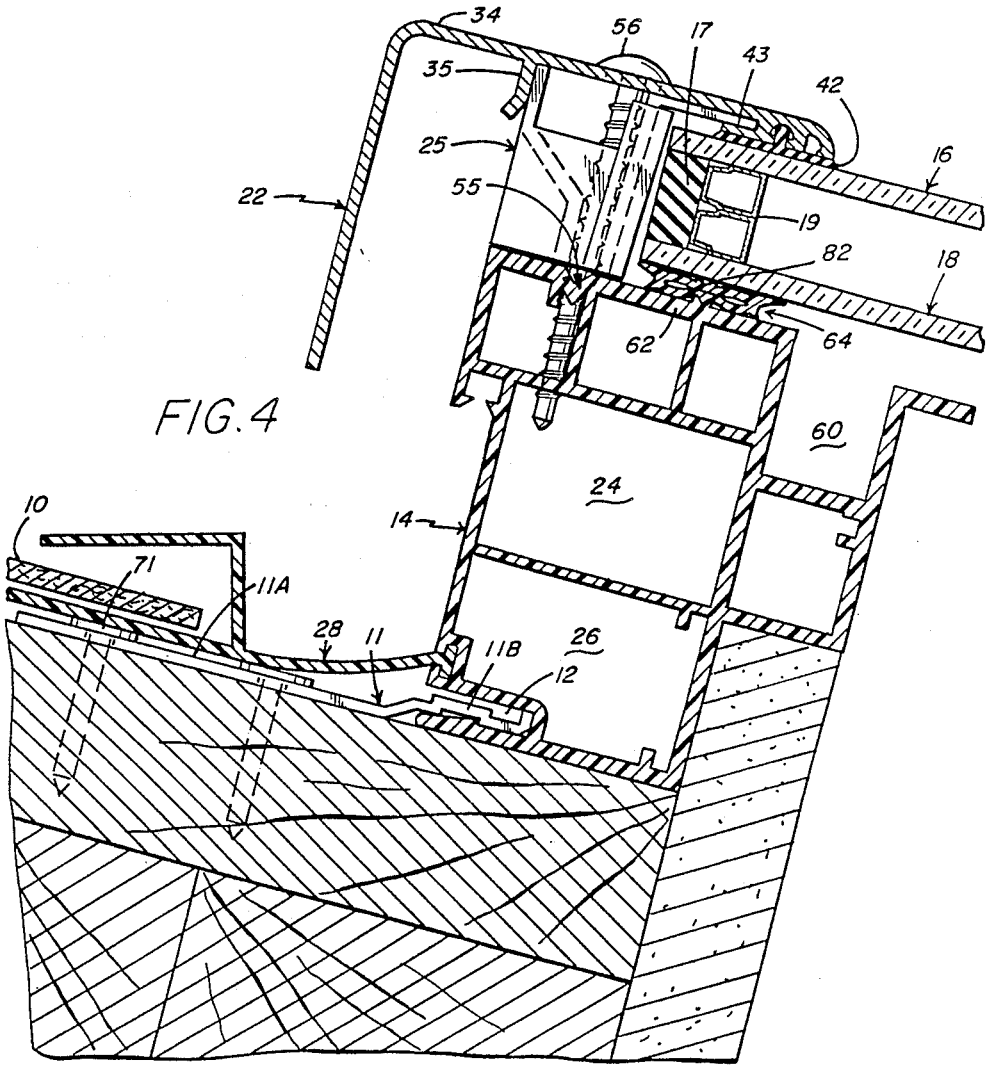
FIG. 4 is a cross-sectional view similar to that of FIG. 2 but for an alternate embodiment of the invention employing a single piece curb frame, basically comprised of a base curb frame, but having the same sealing gasket as in the earlier embodiment described, but for sealing between the curb frame and the glazing.

Reference is now made to FIGS. 3–6 herein for further details of the improved gasket construction as in accordance with the present invention. FIG. 3 is a cross-sectional view substantially the same as the cross-sectional view of FIG. 2, but illustrating the overlying operating leaf 20 pivoted to at least a partially open position. This view has been shown to illustrate the manner in which the gasket 64 reverts to its uncompressed position. In FIG. 2 the gasket 64 has been shown in its partially compressed position while in FIG. 3, once the operating leaf 20 opens, the gasket 64 reverts to its uncompressed position. Described hereinafter in FIG. 4 is the fully compressed position of the gasket 64.

Figure 5:
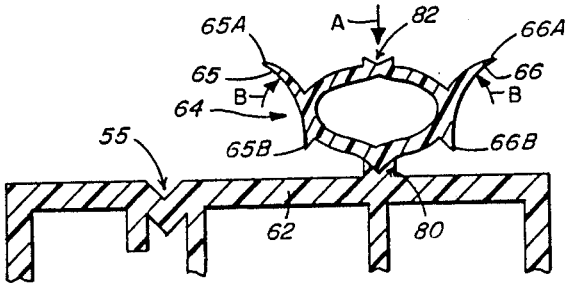
FIG. 5 is an enlarged fragmentary view of the improved gasket of invention.

FIG. 5 is an enlarged fragmentary view showing enlarged details of the multiple area sealing gasket 64. The gasket 64 is generally of cylindrical or tubular construction but is provided with separately disposed ears 65 and 66. Each of these ears, as illustrated in FIG. 5 have tips 65A and 65B, as well as 66A and 66B. The tips 65A and 66A, in the two piece curb frame construction, provide contact with the wall 67. The tips 65B and 66B provide contact with the wall 62 associated with the lower curb frame or base curb frame section.

As also noted in FIG. 5, the gasket 64 is coextruded and integral with the base curb frame section 14. FIG. 5 illustrates the attachment at 80. On the top side of the gasket, as viewed in FIG. 5, in addition to the tips 65A and 66A of the respective ears 65 and 66, there is also provided a relatively small sealing lip 82. The sealing lip 82 is disposed substantially midway between the ears 65 and 66.

Now, in the embodiment of the invention illustrated in FIG.2, it is noted that the gasket 64 is in an essentially partially compressed position. When the gasket is adapted for use between curb frame sections, it is preferred that it be partially compressed and this provides proper gasket sealing. In the position of FIG. 2 it is noted that the ears 65 and 66 have been compressed to the point where the tips thereof contact the respective walls 62 and 67. In this connection the arcuate nature of each of the ears is helpful in providing proper sealing contact with the walls 62 and 67. FIG. 2 also illustrates the sealing lip 82 contacting the wall 67. FIG. 2 clearly illustrates the multiple sealing points or areas provided by this gasket construction.

As indicated previously, one of the advantages of the sealing gasket of the present invention is its universatility of use. FIG. 4 illustrates the further use of the gasket when it is associated with a base curb frame 14 for providing direct sealing between the curb frame and the glazing. In FIG. 4 the skylight construction is shown herein as including a pair of glazing panels 16 and 18, a base frame 14, an operating leaf frame 20, and a retainer 22. The base frame 14 is constructed of a rigid PVC material and the retainer 22 is preferably constructed of a lightweight metal material such as aluminum.

Figure 6:
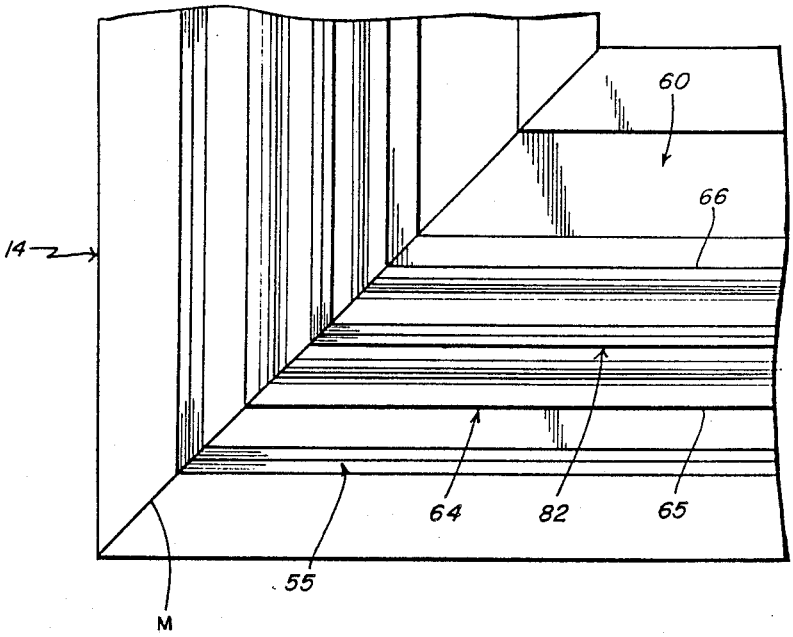
FIG. 6 is a fragmentary top plan view of a corner of the curb frame illustrating the joining of the curb frame and associated gasket at the mitre.

The base frame 14 is constructed by a coextrusion process in which the gasket 64 is coextruded with the rigid frame section. At the corner mitres, as illustrated in FIG. 6 herein, both the rigid and the flexible part of the frame is joined by techniques such as a heat platen sealing technique. This technique commonly joins the rigid frame sections at the corner mitres while at the same time joining the gaskets for providing a continuous seal about the entire curb frame construction. FIG. 6 illustrates the base frame 14 with the sealing gasket 64 as joined at the curb frame mitre M.

The base frame 14 in FIG. 4 has internal compartments 24 and 26 and has associated therewith a peripheral sealing flange 28. The sealing flange 28 interlocks with the base frame 14 and receives a piece of roofing such as the roofing shingle 10. For further details on the construction and associated function of the sealing flange 28, refer to the assignee's U.S. Pat. No. 4,702,049 granted Oct. 27, 1987.

As in the embodiment of FIG. 2, in FIG. 4, to secure the skylight, and in particular the base frame 14, thereof, in place on the roof, there are provided a plurality of securing clips 11, each having one end **11*a* for securing the clip to the roof construction and another end 11*b* received by the base frame 14 at the recess 12. A series of these securing clips 11 may be disposed about all sides of the base frame 14. The securing clip 11 at its end 11*a* is substantially flat and preferably has two holes for receiving roofing nails. The opposite end 11*b* of the securing clip has a stepped construction to enable the securing clip to interlock in the recess 12 in the base frame 14**.

The skylight glazing plates 16 and 18 are supported over the support frame 20 by means of the retainer 22. The plates 16 and 18 are supported by a glazing frame 19. On the outer periphery of the frame 19 between the plates 16 and 18 there is a gasket 17. The gasket 17 may be of a premolded butyl material. As illustrated in FIG. 4, the frame 19 may be comprised of separate metal spacers with an outer seal comprising a chemically curable two-part polysulfide.

The lower glazing plate 18 rests upon the gasket 64 of the present invention. Now, in FIG. 4 it is noted that the gasket 64 is shown in its fully compressed position. In this regard, the ears 65 and 66 are fully deflected with the associated tips thereof contacting and spreading as illustrated in FIG. 4. Parts of even the cylindrical shaped part of the sealing gasket are urged into contact with the plate 18. The sealing lip 82, of course, also makes direct contact with the plate 18.

The base frame 14 also has means defining a channel 55 for receiving a securing bolt 56. The channel 55 is preferably threaded to receive the bolt 56. There are actually a plurality of these securing bolts or screws that are employed for securing the retainer over the glazing plates. The securing bolt 56 in FIG. 4 has associated therewith a cushion member 25. The securing bolt 56 actually passes through the glazing cushioning member 25, forming a cushioning for the edges of the glazing plates to prevent damage thereto, as well as to facilitate positioning thereof.

In the embodiment of the invention illustrated in FIG. 5, as indicated previously, there is basically three point contact to the glazing. This is provided by the sealing lip 82 and the oppositely disposed ear tips **65*a* and 66*a*. This particular construction with the use of a substantially open and somewhat oval shape overall gasket configuration provides improved weather and air tightness. There are three surfaces of contact. Furthermore, there is a reactionary mechanical action that occurs when the gasket is compressed so as to enhance tightness of the gasket between the elements that are being compressed against the gasket. In this regard, once the tips 65***b* and 66*b* are compressed against the wall 62, further compression at 82 as indicated by the arrow A causes a hinging action at the base of the ears 65 and 66. This causes movement of the tips 65*a* and 66*a* in the direction of arrows B as noted in FIG. 5. This mechanical type action assists in providing enhanced tightness regarding the sealing provided by the gasket In essence, the contact at the center of the gasket at its top causes a reactionary force at the ears 65 and 66.

Figure 7:
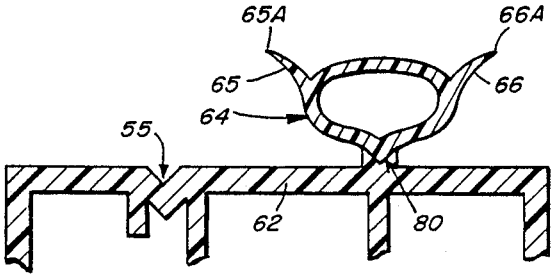
FIG. 7 is a cross-sectional view of an alternate embodiment of a gasket in accordance with the present invention.

Reference is also now made herein to FIG. 7 which is a fragmentary enlarged view of a portion of the curb frame illustrating the gasket of the present invention. In FIG. 7 like reference characters are used to identify like parts as previously described in connection with FIG. 5. FIG. 7 differs from FIG. 5 primarily with respect to the fact that the ears 65 and 66 do not have any lower respective tips 65*b* and 66*b*. Furthermore, the sealing lip 82 is smoothed over in the embodiment of FIG. 7. However, in FIG. 7 it is noted that there is still essentially three point contact regarding this gasket, particularly at the top side of the gasket.

Thus, in accordance with the present invention, there has now been described various embodiments thereof, further illustrating the universal use of the gasket construction. The multi sealing point gasket construction enables one to now use a single form of base frame, wherein the gasket can be employed either for sealing with an overlying frame or with a glazing plate or dome. In this connection, as previously discussed, in the application of FIG. 2 the gasket of the invention is preferably in a partially compressed position while in the embodiment of FIG. 4 is in a substantially fully compressed position.

Having now described a limited number of embodiments of the present invention, it should now become apparent to those skilled in the art that numerous other embodiments and modifications are contemplated as falling within the scope of the present invention, as defined by the appended claims. In the embodiments described herein, such as in FIG. 2 of the drawings, it is noted that the gasket 64 is coextruded with the base of the curb frame. In an alternate embodiment of the invention, this gasket could also be coextruded and integral with the overlying support frame of the curb frame.

What is claimed is:

1. A skylight construction for an opening in a building or the like comprising: a frame means extending about the opening including interior and exterior sides and including means securable about the opening, translucent or transparent means covering the opening and extending at edges to overlie the frame means, means for retaining the covering means on the frame means, said frame means comprising a base frame and a support frame overlying the base frame, both said base frame and said support frame constructed of a rigid plastic material, said base and support frames having associated therewith at least one flexible gasket adapted to be positioned therebetween, and having compressed and uncompressed states depending upon the relative position between the respective base and support frames, said gasket having an attachment segment for securing thereof to one of said frames, said gasket being of tubular construction having a hollow interior, said gasket in its uncompressed state having a maximum width, measured in a direction extending between the interior and exterior sides of the frame means, that is substantially greater than the width of the attachment segment measured in the same direction, said gasket attachment segment being formed so that the gasket is coextruded and integral with said one of said frames, said gasket having multiple contact sealing locations to form multiple seal areas extending along a line extending between the interior and exterior sides of the frame means, said sealing locations disposed on the side of the flexible gasket opposite to said attachment segment.

2. A skylight construction as set forth in claim 1, including a further gasket extending from the support frame and disposed between the support frame and the covering means.

3. A skylight construction as set forth in claim 1 including hinge means between the base frame and support frame.

4. A skylight construction as set forth in claim 1 wherein said covering means includes at least one plate means.

5. A skylight construction as set forth in claim 4 wherein said covering means includes a pair of glazing plates.

6. A skylight construction as set forth in claim 1 wherein said retaining means includes a retainer having one side extending downwardly toward the base frame and another side extending inwardly to contact the edge of the covering means.

7. A skylight construction as set forth in claim 1 including a cup shaped gasket carried by the support frame and upon which the covering means rests.

8. A skylight construction as set forth in claim 1 wherein said multiple contact sealing locations for forming the multiple seal areas includes a closed hollow gasket configuration having oppositely disposed ears.

9. A skylight construction as set forth in claim 8 wherein each of said ears is of generally arcuate shape, having opposite end tips.

10. A skylight construction as set forth in claim 9 wherein the end tips provide sealing areas.

11. A skylight construction as set forth in claim 10 wherein the tips at the top of the ears contact the support frame and the tips at the bottom of the ears contact the base frame in an at least partially compressed position of the flexible gasket.

12. A skylight construction as set forth in claim 11 further including a sealing lip disposed between said ears.

13. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, and a flexible gasket integral and coextruded with the said frame means, said frame means being constructed of the rigid plastic material and said coextruded flexible gasket being constructed of a flexible plastic material, said flexible gasket having multiple and separate contact sealing locations to form multiple seal areas, said gasket being of tubular construction having a hollow interior that enhances pliability and sealing function of the gasket, said sealing locations defined at a side of the gasket remote from the attachment point of the gasket to the frame means.

14. A skylight construction as set forth in claim 13, wherein said gasket has an inner and outer sides thereof oppositely disposed sealing ears defining the sealing locations.

15. A skylight construction as set forth in claim 14 wherein the ears are of arcuate shape and each have end tips.

16. A skylight construction as set forth in claim 15 including a sealing lip on the flexible gasket disposed between the ears.

17. A skylight construction as set forth in claim 16 wherein said flexible gasket is adapted to seal between said frame means and said covering means.

18. A skylight construction as set forth in claim 16 wherein said frame means comprises a base frame and an overlying support frame and said gasket is coextruded and integral from one thereof for sealing therebetween.

19. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, and a flexible gasket integral and coextruded with the said frame means, said flexible gasket having multiple contact sealing locations to form multiple seal areas and including means responsive to contact at one sealing location for providing a mechanical reactionary force at other ones of the contact sealing locations, said gasket being of tubular construction closed to form a hollow interior that enhances pliability and sealing function of the gasket, said sealing locations defined at a side of the gasket remote from the attachment point of the gasket to the frame means.

20. A skylight construction as set forth in claim 19 wherein said flexible gasket has at inner and outer sides thereof, oppositely disposed sealing ears defining the sealing locations.

21. A sealing gasket for use between separable components of a skylight or the like, said gasket having substantially single-point attachment to one of said components in a manner to permit at least limited deflection of said gasket, said single-point attachment being formed by coextrusion of the gasket with said one component, said gasket being of substantially tubular construction having a hollow interior for enhancing pliability and sealing function of the gasket, said gasket having multiple and separate contact sealing locations to form multiple seal areas disposed at a side of the gasket remote from the attachment point of the gasket to said one component.

22. A sealing gasket as set forth in claim 21 wherein said sealing areas are defined by oppositely disposed ears.

23. A sealing gasket as set forth in claim 22 wherein each ear has oppositely disposed tips adapted for gasket sealing at respective components.

24. A sealing gasket as set forth in claim 23 including a sealing lip disposed between said ears.

25. A skylight construction for an opening in a building or the like comprising: a frame means extending about the opening and including means securable about the opening, translucent or transparent means covering the opening and extending at edges to overlie the frame means, means for retaining the covering means on the frame means, said frame means comprising a curb frame, said means for retaining comprising a retainer, and a flexible gasket integral and coextruded with the said frame means, said frame means being constructed of the rigid plastic material and said coextruded flexible gasket being constructed of a flexible plastic material, said gasket being of tubular construction having a hollow interior, said gasket having an attachment segment for securing thereof to one of said frames, said gasket having a width, measured in a direction extending between the interior and exterior sides of the frame means, that is substantially greater than the width of the attachment segment measured in the same direction, said gasket having multiple contact sealing locations to form multiple seal areas extending along a line extending between the interior and exterior sides of the frame means, said sealing locations disposed on the side of the flexible gasket opposite to said attachment segment.

26. A skylight construction as set forth in claim 25 wherein said gasket is of tubular construction having a hollow interior that enhances pliability in sealing function of the gasket, said sealing location defined at a side of the gasket remote from the attachment point of the gasket to the frame means.

27. A skylight construction as set forth in claim 26 wherein said sealing areas are defined by oppositely disposed ears.

28. A skylight construction as set forth in claim 27 wherein each ear has oppositely disposed tips adapted for gasket sealing at respective components of the frame means.

29. A skylight construction as set forth in claim 28 including a sealing lip disposed between said ears.

* * * * *